United States Patent [19]

Lichtenberger et al.

[11] Patent Number: 4,786,390

[45] Date of Patent: Nov. 22, 1988

[54] ANODE CONFIGURATION FOR NICKEL-PHOSPHORUS ELECTROPLATING

[75] Inventors: John A. Lichtenberger, Beavercreek; Nancy E. Myers, Kettering; Rodger L. Gamblin, Dayton, all of Ohio

[73] Assignee: Burlington Industries, Inc., Greensboro, N.C.

[21] Appl. No.: 67,452

[22] Filed: Jun. 12, 1987

Related U.S. Application Data

[60] Division of Ser. No. 732,277, May 9, 1985, Pat. No. 4,673,468, and a continuation-in-part of Ser. No. 923,270, Oct. 27, 1986.

[51] Int. Cl.[4] ..... C25B 9/00

[52] U.S. Cl. ..... 204/242; 204/286; 204/288; 204/289; 204/290 R; 204/290 F; 204/292

[58] Field of Search ..... 204/288, 289, 290 R, 204/290 F, 286, 292, 242

[56] References Cited

U.S. PATENT DOCUMENTS

| | | | |
|---|---|---|---|
| 3,880,721 | 4/1975 | Littauer | 204/288 |
| 4,149,956 | 4/1979 | Bess et al. | 204/288 |
| 4,673,468 | 6/1987 | Myers et al. | 204/24 |

*Primary Examiner*—R. L. Andrews

*Attorney, Agent, or Firm*—Nixon & Vanderhye

[57] ABSTRACT

An anode configuration is provided particularly for a bath that is used for electrolytically plating a substrate with a nickel and/or cobalt phosphorus alloy. The anode comprises a plurality of widely spaced portions of material, preferably of platinum or rhodium. The anode configuration is such that the anode has a very high current density in use—at least 200 amperes per square foot and preferably 500 amperes per square foot. The wide spacing of the anode portions may be provided in a number of different ways. A platinum wire may extend between titanium screws attached to a pair of parallel spaced titanium buses, in a zig-zag manner. A platinum wire may be welded at its opposite ends to a titanium bus, and helically wrapped around the bus, with the welding junctions covered by an insulating material (e.g. vinyl). A platinum tube may be shrink fit onto a titanium bus.

27 Claims, 2 Drawing Sheets

FIG. 1
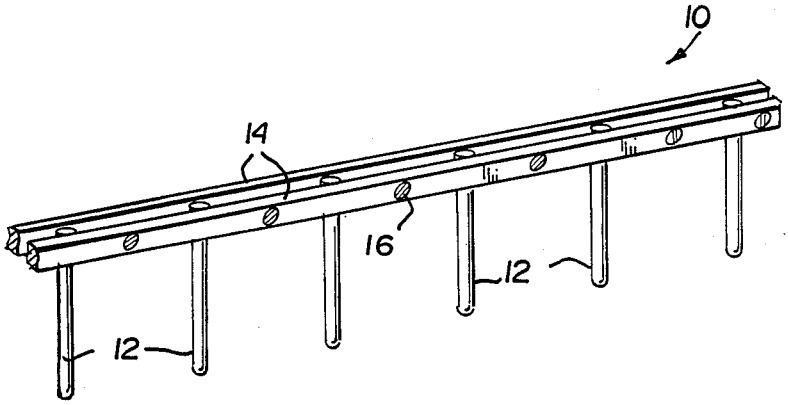
FIG. 3
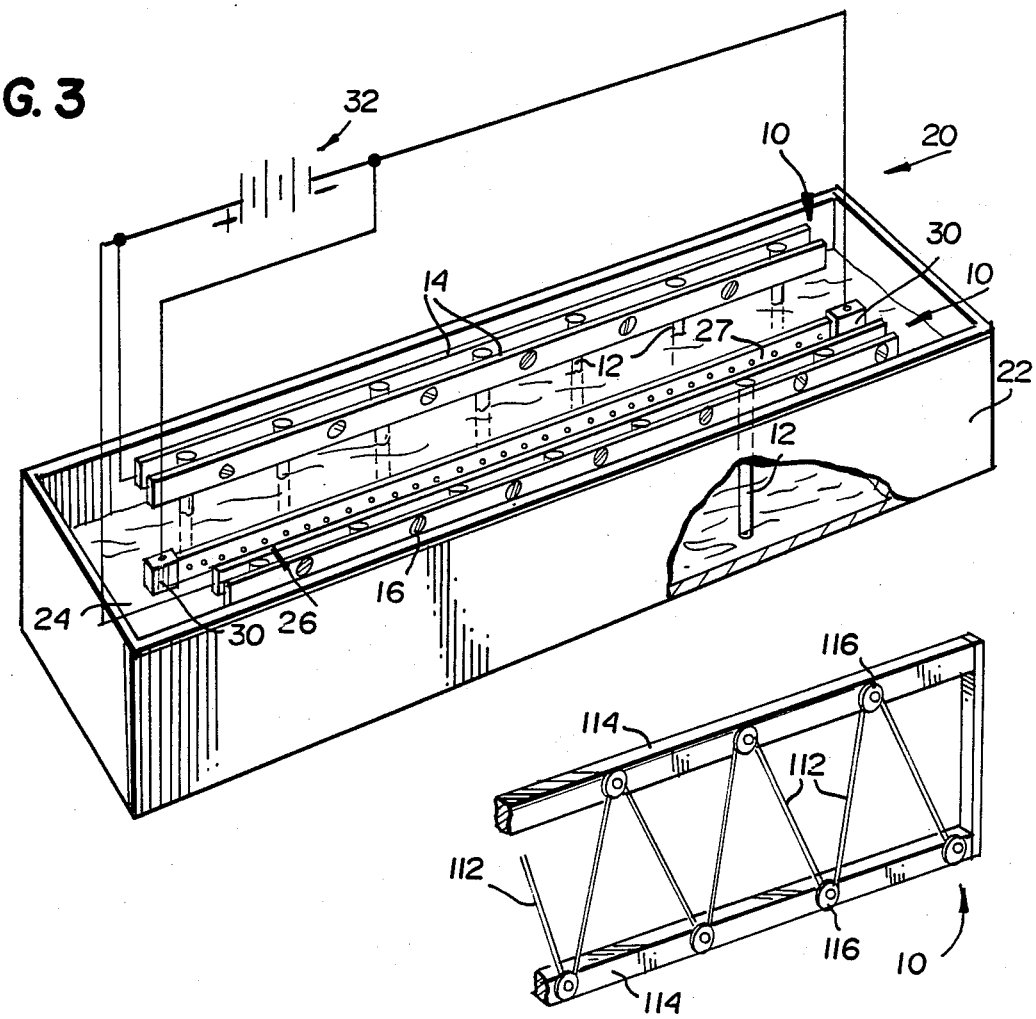
FIG. 2

ANODE CONFIGURATION FOR NICKEL-PHOSPHORUS ELECTROPLATING

CROSS-REFERENCE TO RELATED APPLICATION

This application is a divisional and continuation-in-part of application Ser. No. 732,277 filed May 9, 1985, now U.S. Pat. No. 4,673,468 and a continuation-in-part of application serial number 923,270 filed Oct. 27, 1986.

BACKGROUND AND SUMMARY OF THE INVENTION

The utilization of electrolytically deposited nickel phosphorus, cobalt phosphorus, and nickel cobalt phosphorus coatings having an amorphous structure has been found to be useful in a wide variety of circumstances. For instance a fluid jet orifice plate having enhanced utility, by electrolytically coating the substrate metal of the orifice plate with an amorphous nickel phosphorus alloy, may be produced. The production of electrical contacts, and other products, utilizing such a coating procedure, also has been recognized. While the plated objects so produced have a number of distinct advantages over like but non-coated articles, to date there has not been a truly significant commercialization of a wide variety of nickel and/or cobalt phosphorus coated articles. This may be due, in part, to the relatively quick destruction of baths used in the plating processes.

According to one conventional procedure, in order to obtain an amorphous nickel and/or cobalt-phosphorus coating, the major phosphorus component of the bath is provided by phosphorus acid, with the nickel provided by $NiCl_2$ to various degrees when a cobalt component of the alloy is also desired. Plating can be practiced without any phosphoric acid, but typically a small amount of phosphoric acid (compared to the amount of phosphorous acid) is added to the bath initially in order to facilitate the provision of relatively smooth and bright platings. Such baths are usually operated at as low an anode current density as possible, typically of about 50 amperes per square foot, or less. Upon extended plating utilizing such baths, it has been found that a number of deleterious effects occur in the bath over time. in particular, the platings obtained from the bath degrade in quality over time, in that they are less resistant to corrosion by ferric chloride or concentrated nitric acid. A typical lifetime of the bath before it need be replaced to avoid such quality degradation is about 30–50 ampere-hours per liter. During this lifetime, the cathode efficiency gradually increases from about 40% to about 70%.

According to the present invention it has been found that the major contributor of the deleterious effects on the bath has been the ever increasing concentration of free acid in the bath. A substantial proportion of this free acid is phosphoric acid ($H_3PO_4$), which is believed to result from the oxidation of phosphorous acid ($H_3PO_3$) at the anode. It has been further found according to the present invention that at low anode current densities this oxidation reaction is substantial, whereas at high anode current densities it is much less substantial, and in fact almost non-existent. Therefore, according to the present invention it has been found that it is possible to provide a bath for plating nickel and/or cobalt phosphorus in amorphous form that shows no significant deleterious effects after 250 ampere hours/- liter operation where the anode current density is controlled so as to maintain the phosphoric acid concentration of the bath substantially constant, and so that it does not ever reach a value sufficient to cause deleterious effects. Preferably the phosphoric acid concentration is kept below 0.5 molar. However, it has been found that good plating can be obtained even if the phosphoric acid concentration is up to 4.6 molar, as long as the acid titer is properly controlled. The cathode efficiency of the bath according to the invention retains a value of about 40–50% throughout its life.

While the manifestation of the deleterious effects on the bath is an ever increasing concentration of phosphoric acid, it is believed that the high concentration of phosphoric acid per se is not what results in the deterioration, but rather a condition of overall excessive bath acidity. The desired free acid range in baths according to the invention is so acidic that pH meters are unreliable. Consequently, the free acid concentration is conveniently measured by acid titer. The acid titer is the volume (in milliliters) of deci-normal solidum hydroxide required, when titrating one milliliter of bath, to reach the methyl orange endpoint (which is a pH of about 4.2). The recommended acid titer range is about 9 to 14, representing 0.9 to 1.4 moles/liter of excess acid. The bath is generally maintained approximately 10 mls. acid titer.

At acid titer below 9, the cathode efficiency decreases, undesirably, to below 30%. In the range of about 9 to 13 cathode efficiency is about 40–60%. Above acid titer 14, cathode efficiency increases to the range of 70–80%, but the corrosion resistance of the plating deteriorates, presumably due to a reduced phosphorus content in the plating. The acid titer is lowered by additions of nickel carbonate and increased by additions of phosphorous acid.

There are alternative ways of measuring the free acid level, such as by measuring the $PO_4^{-3}$, $HPO_3^{-2}$, $Cl^-$, and $Ni^{+2}$ levels and deriving the acidity. However the acid titer method is usually easier in practice.

In a presently preferred bath, which yields a more ductile plating and is set forth in said co-pending application Ser. No. 923,270 the disclosure of which is hereby incorporated by reference, the desired acid titer level is between 20 and 30.

Preferably, the anode current density is maintained so that it is always greater than about 200 amperes per square foot. At levels significantly below about 200 amperes per square foot, the desired control of the phosphoric acid buildup and/or free acid concentration does not occur. In fact, anode current densities of at least about 500 amperes per square foot for nickel phosphorus coating baths are preferred. Anode current densities as high as 1250 amperes per square foot are useful, and apparently the upper limits on anode current density are determined by non-electrochemical constraints, such as $I^2R$ corrosion of accessory electrical components (such as bus bars) at higher voltages, etc.

According to the present invention, the anode current density is preferably controlled utilizing a particular anode construction vis-a-vis the cathode construction. Typically, the cathode of the bath is provided by the workpiece being coated, such as fluid jet orifice plate, cookware, cutlery, etc. The cathode-workpiece is immersed in the bath. Disposed adjacent to, but spaced from, the cathode, the anode is immersed in the bath. The anode configuration is selected so that the anode's effective surface area is small enough that the current density is in the desired range.

According to one embodiment of the invention the anode comprises a plurality of spaced strips of anode material, and a section of anode may be provided adjacent each major face of the cathode. For example, an anode may be constructed from 125 individually suspended segments of platinum wire, each having a diameter of about 0.01 inches, and each being about 3.23 inches long. It has been found that platinum and rhodium strips (e.g. wires) are more effective over time than other conventional anode materials, such as iridium, gold, palladium, rhenium, and ruthenium. Platinized titanium prevents the oxidation of phosphorous acid, but spalls and in time becomes unusable.

An anode can be configured of platinum connected to a titanium bus bar by connecting (e.g. welding) the ends of the platinum wire to the titanium bus, wrapping the wire helically around the bus between its ends, and then covering the welds with an insulating material such as a plastic, glass, or ceramic. The insulating material must be able to withstand the bath conditions without significant breakdown or pollution of the bath. The insulating cover may be plastic tubes shrink fit over the welds. In use, the exposed titanium quickly develops a protective oxide covering, while the platinum wire effectively serves as an anode. Since there is a very small anode area, but the bus can carry a significant current, the current density of the anode will be at least 200 (preferbly over 500) amperes per square foot. As will be apparent, an insulating covering is a desirable feature at the location of the titanium/platinum weld, regardless of the specific anode configuration.

According to another aspect of the present invention an anode constructed of platinum and titanium that does not spall is formed by making a thin wire or bar titanium bus, and shrink fitting a platinum tube over the bus. The platinum tube is heated so that it expands, it is placed over the bus, and then cooled, shrinking so that the tube makes a mechanical bond with the bus.

It is the primary object of the present invention to provide an improved apparatus for the production of nickel and/or cobalt phosphorus electrolytically plated articles utilizing a bath having long life, and anode configurations particularly suited for that purpose. This and other objects of the invention will become clear from an inspection of the detailed description of the invention, and from the appended claims.

BRIEF DESCRIPTION OF THE DRAWINGS

FIG. 1 is a schematic perspective view of a portion of a section of an exemplary anode utilizable in the practice of the present invention;

FIG. 2 is a schematic perspective view of a portion of another exemplary anode construction according to the present invention;

FIG. 3 is a schematic perspective view of an exemplary bath in which plating of a fluid jet orifice plate is being practiced, in accordance with the present invention, using anodes like the anode in FIG. 1;

DETAILED DESCRIPTION OF THE DRAWINGS

Figure 4:
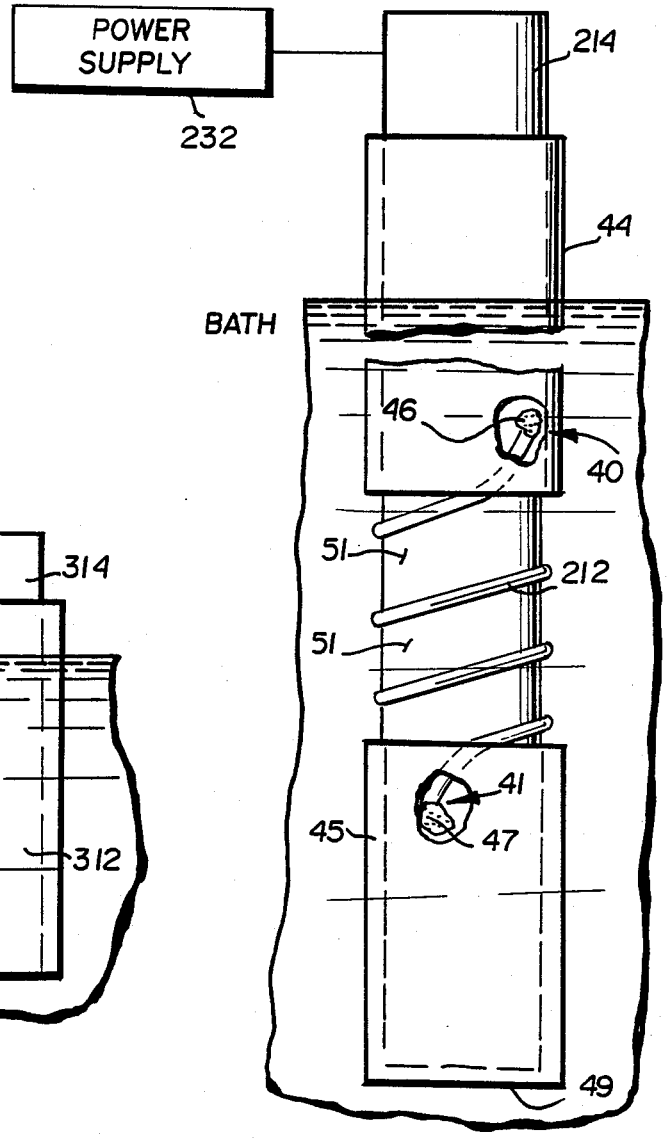
FIG. 4 is an enlarged side schematic view of another exemplary embodiment of anode according to the invention.

According to the invention, it has been found that if the anode current density is maintained at a high enough level, the oxidation of phosphorous acid to phosphoric acid within the plating bath is controlled such that there is essentially no increase in the level of phosphoric acid within the bath, so that deleterious effects that result from an increasing concentration of $H_3PO_4$ are avoided, and/or the free acid concentration is controllable so that it is in an acid titer range of about 9–14 (or 20–30, depending on the bath formulation used). The bath can have an indefinite life as long as phosphorous acid and sources of nickel and/or cobalt are added. These sources initially are preferably in the form of $NiCl_2$ and/or $CoCl_2$, to promote conductivity, together with lesser amounts of $NiCO_3$ and/or $CoCO_3$. Makeup sources during plating preferably are $NiCO_3$ and/or $CoCO_3$, to avoid chloride buildup in the bath, while evolving $CO_2$. Preferably according to the method of the present invention the anode current density is maintained at a minimum level of about 200 amperes per square foot, with a preferred anode current density, particularly for nickel phosphorus plating, of a minimum of about 500 amperes per square foot. The desired high anode current density may be achieved according to the present invention by utilizing an anode of small effective area, utilizing various anode configurations.

One desirable particular anode configuration according to the present invention is illustrated schematically, generally, by the reference numeral 10 in FIG. 1. The anode 10 consists of a large plurality of widely spaced, essentially parallel, strips (e.g. wires, or rectangular cross-section segments) 12 of anodic material. The strips are held in their widely spaced positions, as illustrated in FIG. 1, preferably by a pair of titanium bars 14, with one end of each of the strips 12 being sandwiched between the bars 14, and with screws 16, or like fasteners, clamping the strips between the bars 14, with a screw 16 disposed between each pair of strips 12. For best operation, the anodic material comprising the strips 12 is selected form the group consisting essentially of platinum and rhodium. Iridium, gold, palladium, rhenium, ruthenium, and other like conventional anodic materials, are much less desirable.

The length, cross-sectional area, number, spacing, and like variables of the anode strips 12 may vary widely, so long as the general requirements of maintaining an anode current density of at least about 200 amperes per square foot (and preferably at least about 500 amperes per square foot) are met. In one example an anode 10 would comprise 125 strips 12 of platinum wire having a diameter of 0.01 inches, and each strip having a length of 3.23 inches.

Another exemplary anode configuration is illustrated at 110 in FIG. 2, and comprises a piece of platinum or rhodium wire 112 which zig-zags back and forth between titanium screws 116 associated with a pair of titanium bus bars 114, to provide widely spaced portions.

The anode configuration will vary depending upon the shape of the piece being plated, with the object being to have the anode equidistant to all parts of the piece being plated, to insure uniform plating.

A typical bath according to the present invention is illustrated schematically and generally by reference numeral 20 in FIG. 3. The bath 20 includes a container 22 of conventional construction and material, having the bath liquid 24 disposed therein. The bath liquid initially includes $NiCl_2$ and/or $CoCL_2$, a small amount of $NiC0_3$, a relatively large amount of phosphorous acid, and a relatively small amount of phosphoric acid. Of course other bath constituents can be utilized depending on the particular workpieces being plated, and other conditions. In particular the bath of said U.S. application Ser. No. 923,270 is desirable. Bath additives that might affect electrical resistance of the workpieces being plated, or corrosion protection, include boric acid, acetic acid, surfactants of the alkoxylated linear alcoholic class, succinic acid, and the like. Typical constituents of an initial plating bath would be 1.25 molar $H_3PO_3$, 0.30 molar $H_3PO_4$, 0.25 molar $NiCO_3$, with $NiCl_2$ and $CoCl_2$ together comprising about 0.75 molar. Where no cobalt is provided in the final alloy, but the final alloy being coated is solely nickel phosphorus, as much as about 0.90 molar $NiCl_2$ may be desirable.

In initially making up the bath, the nickel chloride, phosphorous acid, and phosphoric acid are added to the bath as liquids and nickel carbonate is added to adjust acid titer. As noted above, makeup of nickel ions as plating proceeds is preferably effected by addition of $NiCO_3$ at the intervals.

The bath 20 further comprises, immersed therein, one or more anode sections 10. As illustrated schematically in FIG. 3, the anode sections 10 are disposed with respect to the bath container 22 so that most of the length of the strips 12 thereof is immersed in the bath, while the titanium buses 14 remain above the level of the bath. For the bath 20 illustrated in FIG. 3, the cathode-workpiece is in the form of a fluid jet orifice plate 26 which has a pair of opposite major side faces thereof, one of the side faces 27 being seen in FIG. 3, which major side faces have significantly more area than the other portions of the plate 26. The plate 26 is typically clamped by clamps 30 at the ends thereof so that it is immersed within the bath, and an anode section 10 is disposed on either side of the plate 26 so that each of the anode sections 10 is parallel to and adjacent (but spaced from) one of the faces (e.g. face 27). A typical spacing between the anode 10 adjacent the face 27 and the other face 27 is 8.5 inches, although the spacing may be varied widely depending upon the type of cathode-workpiece 26, and other conditions.

The apparatus 20 according to the invention includes as the final major component a battery 32, or like source of electrical power, which is operatively electrically connected to the anode sections 10, and to the cathode-workpiece 26.

In the practice of the present invention, the cathode current density will widely vary depending upon the particular geometry of the cathode-workpiece, and other variables. A typical cathode current density would be about 50 amperes per square foot, regardless of the cathode area. Typical variations in cathode area, and like parameters, in exemplary manners of practice of the invention are indicated by the following table I':

TABLE I

| CATHODE AREA PER SIDE | AMPERES/NODE | ANODE WIRE DIAMETER | ANODE CURRENT DENSITY | VOLTAGE |
|---|---|---|---|---|
| .5 sq. ft. | 25 | .01" | 280 ASF | |

TABLE I-continued

| CATHODE AREA PER SIDE | AMPERES/NODE | ANODE WIRE DIAMETER | ANODE CURRENT DENSITY | VOLTAGE |
|---|---|---|---|---|
| 1 sq. ft. | 50 | .01" | 570 ASF | 5.6–5.9 volts |
| 1.76 sq. ft. | 88 | .008" | 1250 ASF | |
| 1.76 sq. ft. | 88 | .01" | 1000 ASF | 7.9–8.0 volts |

A typical example of the practice of plating using an anode configuration according to the present invention is as follows:

EXAMPLE

An initial bath formulation comprising 1.25 molar $H_3PO_3$, 0.3 molar $H_3PO_4$, 0.90 molar $NiCl_2$, and 0.25 molar $NiCO_3$, was provided. Two anodes 10 having platinum strips (portions) 12, as illustrated in FIGS. 1 and 2, were provided, and the cathode-workpiece 26 being plated was a 1.8 meter long plate. A number of plates 26 were consecutively plated, with sufficient $NiCO_3$ and phosphorous acid being added at intervals to replenish the nickel and phosphorus components of the bath. $H_3PO_4$ concentration readings were taken at various points of time, and were 0.31, 0.31, 0.28, and 0.30 molar respectively. Nickel phosphorus coatings produced were amorphous, with a high concentration (viz. about 20+ atomic percent) of phosphorus. The anode current density was about 1,000 amperes per square foot, with an anode amperage of 88 amperes.

In the FIG. 4 embodiment of the invention, a titanium bus bar 214 connected to a power supply 232 supports a platinum or rhodium electrode. For example, a platinum wire 212 having spaced portions (ends) 40, 41, is connected to the bus 214 at those spaced portions 40, 41. Preferably the connection is by welding—see welds 46, 47. It has been found that during plating with such an anode a small leakage current passes through the titanium to the bath at the weld between titanium and platinum. As a result the titanium corrodes in the region of the weld, weakening the connection and allowing the platinum anode to become severed from the titanium bus. According to the invention this is avoided by providing an insulative covering on the bus bar/anode connections—that is over the welds. The insulation may be a plastic material, such as a vinyl-like pvc, polytetrafluoroethylene, or polyethylene; or a glass, or ceramic. It essentially may be any material which is suitably electrically resistive and chemically inert in the highly corrosive bath environment, and which will not pollute the bath. In the embodiment illustrated in FIG. 4, the insulative covering is provided by a pair of plastic tubes 44, 45, which are shrink fit over the welds 46, 47. A plastic tube, such as a vinyl tube, is heated to expand, and then slipped over the portion of the bus bar covering the weld to the platinum wire. Note that the tube 45 has an end cap 49, covering the end of the bus 214.

The construction of FIG. 4 is very desirable in that the anode area is kept to a minimum (only the exposed portions of the platinum wire—that is those portions outside the coverings 44, 45) while still carrying a great deal of current to the electrode. The titanium bus 214 carries a large current without excessive heating despite being in air, which is a poor heat sink, while the platinum electrode 212 provides the necessary small anode area so that the anode current density is at least 200 amperes per square foot and preferably greater than 500 amperes per square foot. The platinum, despite the fact that it has a small volume, does not overheat since the bath serves as a coolant. In use the portion 51 of the titanium bus bar within the bath that is exposed to the bath quickly oxides when voltage is applied, providing a resistive coating so that the current passes through the surface of the platinum, and not the titanium (for the most part).

In the construction of the anode of FIG. 4, initially the bare titanium metal is cleaned in a fluoride containing acid, such as hydrofluoric acid. After welding one end 40 at weld 46 to the bus bar, the electrode wire 212 is helically wrapped around the bus bar 214 and the other end 41 is welded at 47 to the bus to 214. Then the shrink fit tubes 44, 45 are applied over the welds 46, 47. The tubes 44, 45 not only provide a protective function for the titanium bus at the welds, but also other portions that they cover. As will be apparent, the notion of applying the insulative coating to anode/bus bar welds is applicable to other geometries, including those of FIGS. 1 and 2.

Figure 5:
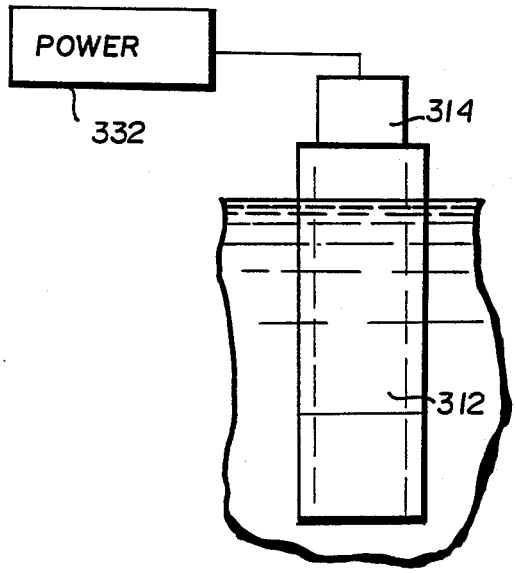
FIGS. 5 and 6 are side and end views, respectively, of a still further embodiment of anode according to the invention.
Figure 6:
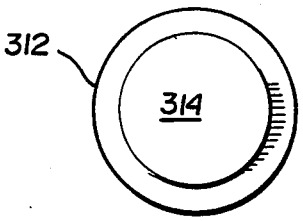
Figure 7:
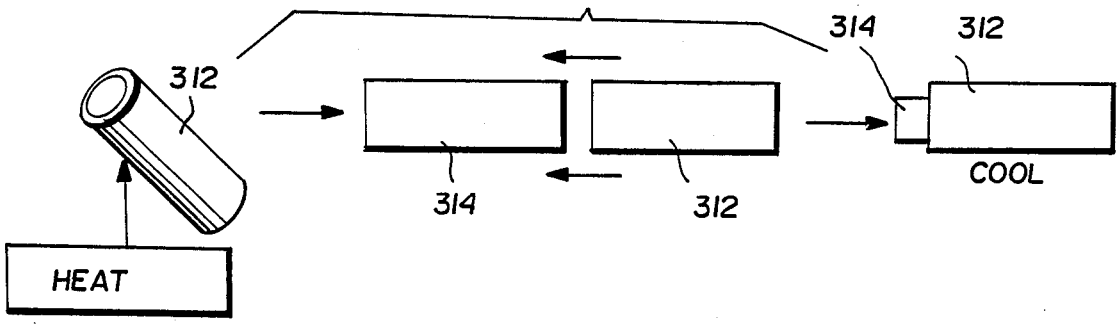
FIG. 7 schematically illustrates a method of construction of the anode of FIGS. 5 and 6.

FIGS. 5 and 6 illustrate another embodiment of anode configuration according to the invention, and FIG. 7 schematically illustrates a method of construction of the anode of FIGS. 5 and 6. The anode of FIGS. 5 and 6 comprises a thin wire or bar titanium bus 314, having a tube of platinum or rhodium, 312, disposed thereover, and protecting it. The connection of the tube 312 to the bus 314 is provided by heating the tube 312 so that it expands (the tube 312 initially having an interior diameter the same as, or only very slightly greater than, the outside diameter of the bus 314); then inserting the bus 314 into the tube 312 (moving the tube 312 over the bus 314); and then allowing the system to cool so that the tube 312 shrinks to fit over the bus 314, making a mechanical bond therewith. The bus 314 is connected up to a power supply 332. In use in a commercial bath, of course a large number of the electrodes 312, 314 would be provided. They would be arranged in a uniform manner within the bath to provide appropriate uniform electroplating, and the size of the anodes, and the number thereof, would be such so that the anode current density was at least 200 amperes per square foot, and preferably at least 500 amperes per square foot.

Other techniques may also be developed for covering, plating, or coating titanium rods or bars with platinum so as to provide an effective anode construction.

The use of the insulation to protect the welds of anodes and bus bars is particularly suitable to the nickel-phosphorus and cobalt-phosphorus platings described hereinabove, because of the desirability of maintaining the anode area at a minimum to increase the anode current density. However, this aspect of the invention is also useable in other plating regimes and is desirable, in particular, wherever anode current densities are high, such as the plating onto the interior surface of tubes with a wire anode concentric with the tube-cathode.

It will thus be seen that according to the present invention a bath with particular anode construction, and particular anode configurations, have been provided which are advantageous, particularly in the plating of a substrate with nickel and/or cobalt phosphorus. While the invention has been herein shown and described in what is presently conceived to be the most practical embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. Apparatus for electrolytically plating a substrate with a nickel and/or cobalt phosphorus alloy, comprising:

a bath including $NiCl_2$ and/or $CoCl_2$, phosphorous acid, and phosphoric acid;

a work piece to be plated disposed as a cathode in the bath;

an anode immersed in said bath, and comprising a plurality of portions widely spaced and having a small surface area as means for effecting a high current density, and of material selected from the group consisting essentially of platinum and rhodium; and a source of electrical power operatively connected to the anode and cathode.

2. Apparatus as recited in claim 1 wherein the cathode-workpiece has first and second side surfaces substantially larger than the other surfaces of said cathode-workpiece; and wherein said anode comprises first and second sections, each section having a plurality of said portions of widely spaced material, said first anode section being disposed so that its portions, in the form of strips, are essentially vertical, and parallel to, and adjacent—but spaced from—said first cathode side surface, and said second anode section disposed so that its portions, in the form of strips, are essentially vertical, and parallel to, and adjacent—but spaced from—said second cathode side surface, with said cathode-workpiece disposed between said anode first and second sections.

3. Apparatus as recited in claim 1 wherein said anode comprises a wire of platinum or rhodium passing in a zig-zag path between a pair of spaced bus bars.

4. Apparatus as recited in claim 1 wherein the concentration of phosphoric acid is less than about 0.5 molar.

5. Apparatus as recited in claim 1 wherein said anode comprises: a metal bus; at least one wire of platinum or rhodium attached to said bus at points of attachment spaced along said bus; and electrical insulating means of a material capable of withstanding the environment of said bath without significant corrosion and without significantly polluting the bath, said insulating means covering said wire and bus at said points of attachment of said wire to said bus, said wire being exposed to the bath where not covered by said insulating covering.

6. Apparatus as recited in claim 5 wherein said bus is titanium.

7. Apparatus as recited in claim 6 wherein said insulating means comprises at least a pair of shrink fit plastic tubes.

8. Apparatus as recited in claim 6 wherein said wires are connected at said points of attachment to said bus by welding.

9. Apparatus as recited in claim 7 wherein one of said shrink fit tubes has an end cap, providing a bottom termination for said anode.

10. Apparatus as recited in claim 8 wherein said wire is platinum.

11. Apparatus as recited in claim 5 wherein said insulating means is selected from the group consisting essentially of polytetrafluorethylene, pvc, polyethylene, glass, ceramics, and vinyls.

12. Apparatus as recited in claim 1 wherein each anode comprises a metal bus with a shrink fit tube of platinum or rhodium over said bus, and making a mechanical bonding with said bus.

13. Apparatus as recited in claim 12 wherein said bus is titanium and said tube is platinum.

14. An anode comprising:

a pair of spaced bus bars;

a wire disposed in a zig-zag configuration between said bus bars, with a great deal of void space between portions of the wire, and operatively attached to the bus bars; and said wire so dimensioned with respect to said bus bars that said anode has an anode current density of at least about 200 amperes per square foot, in use.

15. An anode as recited in claim 14 wherein said wire is selected from the group consisting essentially of platinum or rhodium, and further comprising means for applying an anode current density of at least about 500 amperes per square foot, in use.

16. An anode as recited in claim 14 wherein said bus bar is titanium, and wherein said wire extends in a zig-zag configuration between titanium screws extending outwardly from said titanium bus bar; and wherein said wire is from the group consisting essentially of rhodium and platinum.

17. An anode comprising:

a conductive metal bus;

a wire, made of a material capable of serving as an anode, attached to said bus at at least one point along the length of said bus; and insulating material covering means covering said wire and said bus at the points of attachment of said wire to said bus, the remainder of said wire being exposed where not covered by said insulating cover.

18. An anode as recited in claim 17 wherein said wire is selected from the group consisting essentially of platinum and rhodium, the wire connected at its ends to the bus, and helically wrapped around the bus.

19. An anode as recited in claim 17 wherein said bus is titanium.

20. An anode as recited in claim 17 wherein said wire is connected to said bus by welding.

21. An anode as recited in claim 17 wherein said insulating means comprises a tube of plastic material shrink fit over said bus at each point of attachment of the wire to the bus.

22. An anode as recited in claim 17 having an anode current density of at least 200 amperes per square foot, in use.

23. An anode comprising:

a conductive metal bus; and a tube selected from the group consisting essentially of platinum and rhodium which fits over said bus encircling said bus and making a mechanical bond thereto; said bus being longer than said tube.

24. A method of constructing an anode from a bus, wire, and a tube of insulating plastic material, comprising the steps of:

(a) attaching the wire to the bus at spaced locations of the wire;

(b) heating the tube to expand it;

(c) placing a tube over each connection of the wire to the bus; and (d) cooling the tube so that the connection of the wire to the bus are covered, but the wire is exposed along the majority of the length thereof; whereby the bus, wire, and tube provide an anode construction, with the wire serving as an electrode.

25. A method as recited in claim 24 wherein the bus is titanium comprising the further step of, prior to the connection of the wire to the bus, cleaning the bus in a fluoride containing acid.

26. A method as recited in claim 24 wherein step (a) is practiced by attaching the ends of a platinum or rhodium wire to the bus, with the wire in a helix around the bus between its ends.

27. A method of constructing an anode from a bus of conductive metal, and a tube of platinum or rhodium having an inside diameter just slightly greater than, or equal to, the outside diameter of said metal bus, comprising the steps of:

heating the tube so that it expands;

placing the tube over the bus so that the tube encircles the bus; and cooling the tube so it shrink fits on the bus and makes a mechanical bond thereto, whereby the tube serves as an electrode.

* * * * *